US008026890B2

(12) United States Patent
Anai

(10) Patent No.: US 8,026,890 B2
(45) Date of Patent: Sep. 27, 2011

(54) FLAT DISPLAY DEVICE HAVING A COMMON VOLTAGE GENERATION SECTION FOR GENERATING A STABLE AVERAGE DC POTENTIAL AND A CONTROL METHOD THEREOF

(75) Inventor: Kimio Anai, Fukaya (JP)

(73) Assignee: Toshiba Matsushita Display Technology Co. Ltd, Tokyo (JP)

( * ) Notice: Subject to any disclaimer, the term of this patent is extended or adjusted under 35 U.S.C. 154(b) by 925 days.

(21) Appl. No.: 11/968,694

(22) Filed: Jan. 3, 2008

(65) Prior Publication Data

US 2008/0165177 A1 Jul. 10, 2008

(30) Foreign Application Priority Data

Jan. 5, 2007 (JP) ..... 2007-000680

(51) Int. Cl.
*G09G 3/36* (2006.01)

(52) U.S. Cl. ..... 345/99

(58) Field of Classification Search ..... 345/211–213, 345/98–100

See application file for complete search history.

(56) References Cited

U.S. PATENT DOCUMENTS

| | | | | |
|---|---|---|---|---|
| 5,122,790 | A * | 6/1992 | Yasuda et al. | 345/96 |
| 2003/0151572 | A1 * | 8/2003 | Kumada et al. | 345/87 |
| 2006/0012593 | A1 * | 1/2006 | Iriguchi et al. | 345/204 |
| 2007/0164963 | A1 * | 7/2007 | Kim et al. | 345/98 |

FOREIGN PATENT DOCUMENTS

JP 2003-162258 6/2003

* cited by examiner

*Primary Examiner* — Chanh Nguyen
*Assistant Examiner* — Long Pham
(74) *Attorney, Agent, or Firm* — Finnegan, Henderson, Farabow, Garrett & Dunner, L.L.P.

(57) ABSTRACT

According to one embodiment of the present invention, a flat display device which makes drive voltage polarity of pixels of adjacent lines reversed polarity, while drives to reverse drive voltage polarity of the same line on a frame-by-frame basis, has common voltage generation circuit for supplying a common voltage signal to a facing electrode of the flat display device and a control circuit for generating a common voltage control signal supplied to the common voltage generation circuit. The control circuit obtains a control signal for generating common voltage whose average DC potential does not vary, by using a horizontal synchronization timing signal, a vertical synchronization timing signal, and a clock signal. In order to obtain the control signal, the device has an (fh/2) signal generation circuit, an (fv/2) signal generation circuit, an (fh×n) signal generation circuit, an multiplication circuit, a selection control circuit, and a selection circuit.

4 Claims, 9 Drawing Sheets

FLAT DISPLAY DEVICE HAVING A COMMON VOLTAGE GENERATION SECTION FOR GENERATING A STABLE AVERAGE DC POTENTIAL AND A CONTROL METHOD THEREOF

CROSS-REFERENCE TO RELATED APPLICATIONS

This application is based upon and claims the benefit of priority from prior Japanese Patent Application No. 2007-000680, filed Jan. 5, 2007, the entire contents of which are incorporated herein by reference.

BACKGROUND OF THE INVENTION

1. Field of the Invention

One embodiment of this invention relates to a flat display device and its control method. More specifically, this invention concerns improvement in control means and a control method of common voltage.

In a liquid crystal display, a driving method, in which drive voltage polarity of pixels of adjacent lines are made reverse polarity while drive voltage polarity of the same line is reversed every predetermined period of time (for example, on a frame-to-frame basis), is adopted (e.g., Japanese Patent Application No. 2003-162258). This is because LC driveability deteriorates when the same electrode is driven by the same polarity at all times, and this causes the deterioration of image quality.

As mentioned above, when the drive voltage polarity of pixels is switched, the polarity of drive voltage (common voltage) of a facing electrode (common electrode) is also switched. Polarity of the common voltage supplied to the facing electrode is controlled to be switched between positive polarity and negative polarity every line period, the average voltage thereby comes to constant DC voltage.

Common voltage control signals for switching polarity of common signals supplied to the facing electrode are generated by using horizontal synchronization timing signals and horizontal synchronization timing signals, and also clock signals.

Now, a video signal that is realized in such a way that one frame cycle comprises (2m+1) lines is considered. When AC voltage which is to be supplied to the facing electrode is applied, voltage of the facing electrode comes to DC voltage with relative stability due to a common voltage control signal generated by using the horizontal synchronization timing signal and vertical synchronization signal of the video signal. In contrast, a video signal that is realized in such a way that one frame cycle comprises (2m) lines is considered. When AC voltage which is to be supplied to the facing electrode is applied, voltage of the facing electrode comes to DC voltage that varies with frame cycles due to the common voltage control signal generated by using the horizontal synchronization timing signal and the vertical synchronization signal of the video signal. As a result, according to the flat display device having a drive circuit of the facing electrode as described above, brightness of the screen varies depending on the number of lines contained in a frame of an input video signal.

BRIEF SUMMARY OF THE INVENTION

An object of the embodiments of the present invention is to provide a flat display device and its control method that are able to suppress the variation of brightness of the screen which occurs depending on the number of lines in an input video signal, even when common voltage is driven on AC.

According to one aspect of the present invention, there is provided a flat display device which makes drive voltage polarity of pixels of adjacent lines reversed polarity, while drives to reverse drive voltage polarity of the same line on a frame-by-frame basis, wherein the flat display device comprises common voltage generation means for supplying a common voltage signal to a facing electrode of the flat display device and means for generating a common voltage control signal supplied to the common voltage generation means, characterized in that the means for generating a common voltage control signal comprises: means for generating, based on a horizontal synchronization timing signal, a first signal having frequency of (fh/2) (fh: horizontal frequency) which reverses lines on a line-by-line basis; means for generating, based on a vertical synchronization timing signal, a second signal having frequency of (fv/2) (fv: vertical frequency) which reverses lines on a line-by-line basis; means for generating, based on a horizontal synchronization timing signal and a clock signal, a third signal of positive polarity and a third signal of negative polarity having frequency of nth of fh; multiplication means for performing multiplication of the first and second signals and outputting a fourth signal; selection means to which the third signal having positive polarity, the third signal having negative polarity, and the fourth signal are supplied, for selecting and outputting one of the signals; selection control means for determining signal selection mode according to whether one cycle of the second signal contains odd cycles of the first signals or even cycles of the first signals; and common voltage output means for generating, based on signals obtained from the selection means, the common voltage signal.

According to the above-described means, the variation of brightness of the screen which occurs depending on the number of lines of a video signal to be input can be suppressed, even when common voltage is driven on AC.

Additional objects and advantages of the embodiments will be set forth in the description which follows, and in part will be obvious from the description, or may be learned by practice of the invention. The objects and advantages of the invention may be realized.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Various embodiments according to the invention will be described hereinafter with reference to the accompanying drawings.

Figure 1:
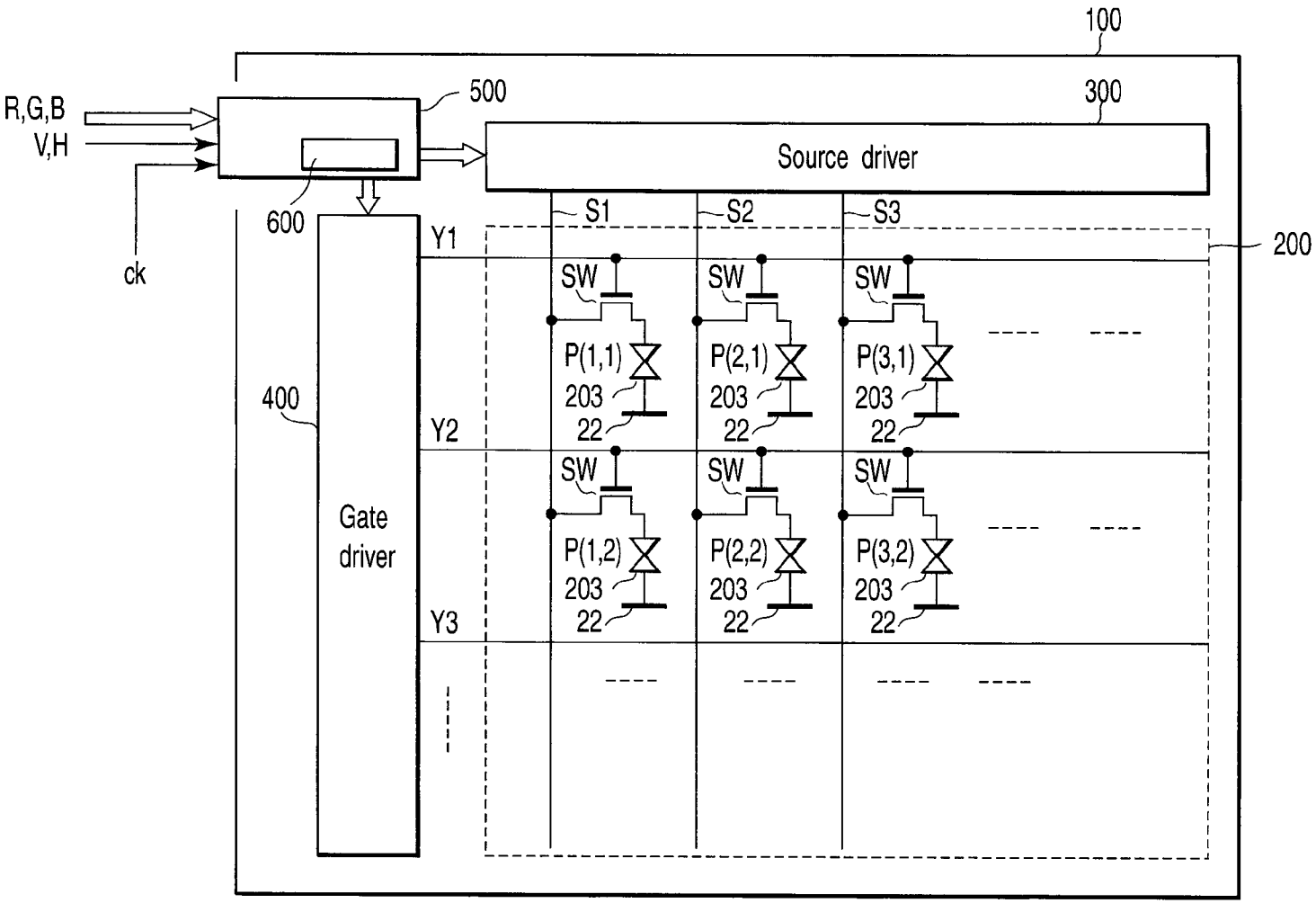
FIG. 1 is a diagram showing overall functional blocks of a flat display device to which the present invention is applied.
Figure 2:
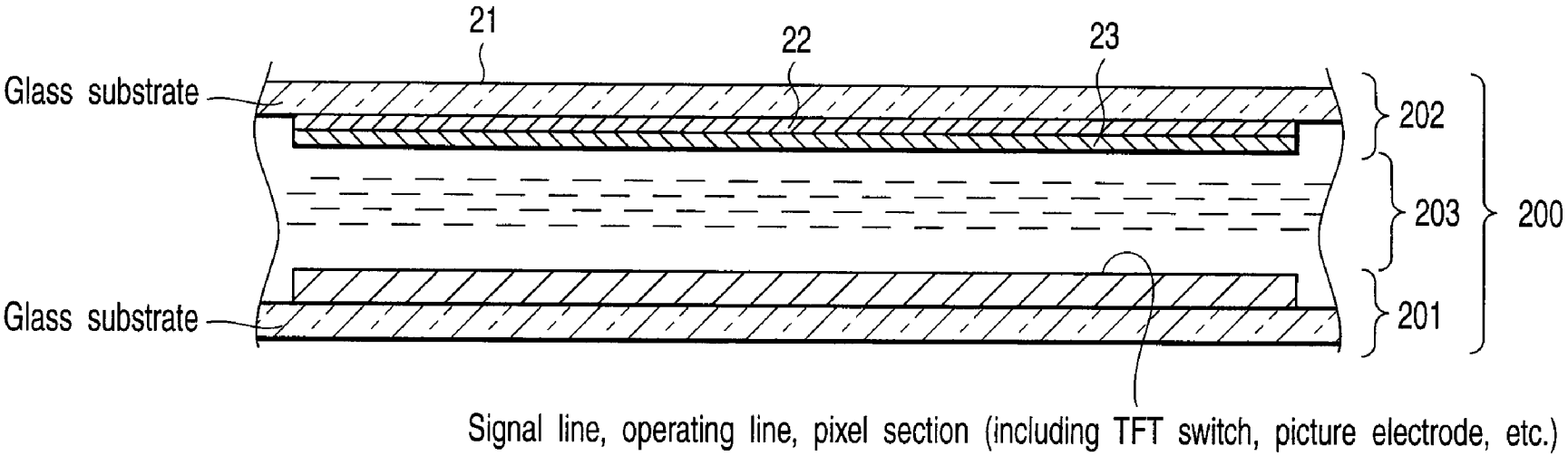
FIG. 2 is a view schematically showing a cross section of the flat panel display of FIG. 1.

FIG. 1 shows a flat display device to which the present invention is applied, and FIG. 2 is a view showing a cross section of a part of the flat display device. Now, the explanation will be given with reference to FIGS. 1 and 2.

200 is a display and it comprises an array substrate 201 in which pixel sections are two-dimensionally arranged, and a facing substrate 202 including a common electrode. Parts indicated as P(1,1), P(2,1), . . . , P(1,2), P(2,2), P(3,2), . . . are pixel sections. A liquid crystal layer 203 is interposed between the array substrate 201 and the facing substrate 202.

The facing substrate 202 comprises a glass substrate 21, a common electrode 22, and an oriented film 23. In FIG. 1, the common electrode 22 and the liquid crystal layer 203 are symbolically indicated.

In each pixel section, a switch SW utilizing a thin-film transistor (TFT) is formed. One end terminal of the switch SW is connected to a signal line and the other end terminal is connected to a pixel electrode. S1, S2, S3, . . . stand for signal lines. Also, to each gate electrode of switches SW, a scanning line is connected. Y1, Y2, Y3, . . . stand for scanning lines. Pixel signals which are supplied to respective pixels are output from a source driver 300 to the signal lines S1, S2, S3, . . . Furthermore, a gate driver 400 is connected to the scanning lines Y1, Y2, Y3, . . . , and this gate driver 400 sequentially accesses the plurality of scanning lines on line-by-line basis. Switches SW connected to accessed scanning lines turn on, and pixel signals can be written into pixel electrode sections via corresponding signal lines. This drives a liquid crystal arranged between the pixel electrode and the common electrode.

As described above, in the display 200, the plurality of pixels are two-dimensionally arranged and the plurality of scanning lines are arranged along the plurality of pixels in each line, and the plurality of signal lines are arranged along the plurality of pixels in each column. The gate driver 400 drives the plurality of scanning lines, and the source driver 300 supplies the plurality of pixels with video signals via the plurality of signal lines.

500 is a control section which transfers externally input video signals (R, G, B signals) to the source driver 300 on line-by-line basis. Also, the control section 500 generates timing signals of every kind including clock signals that are synchronized with horizontal synchronization timing signals fh and vertical synchronization timing signals fv, and the control section 500 supplies the source driver 300 and the gate driver 400 with suitable timing signals.

The control section 500 also controls voltage supplied to each scanning line and voltage supplied to the common electrode 22. More specifically, this device performs, under the control of the control section 500, drive in which drive voltage polarity of pixels of adjacent lines is made reversed polarity and drive voltage polarity of the same line is reversed on a frame-by-frame basis. Furthermore, the device supplies the common electrode 22 with AC voltage. This leads to effective drive of liquid crystal molecules and the display is thereby stabled.

This flat display device 100 is characterized by a method for supplying AC voltage to the common electrode 22 and a method for generating AC voltage. The common voltage generation section 600 is arranged, for example, in the control section 500.

Figure 3:
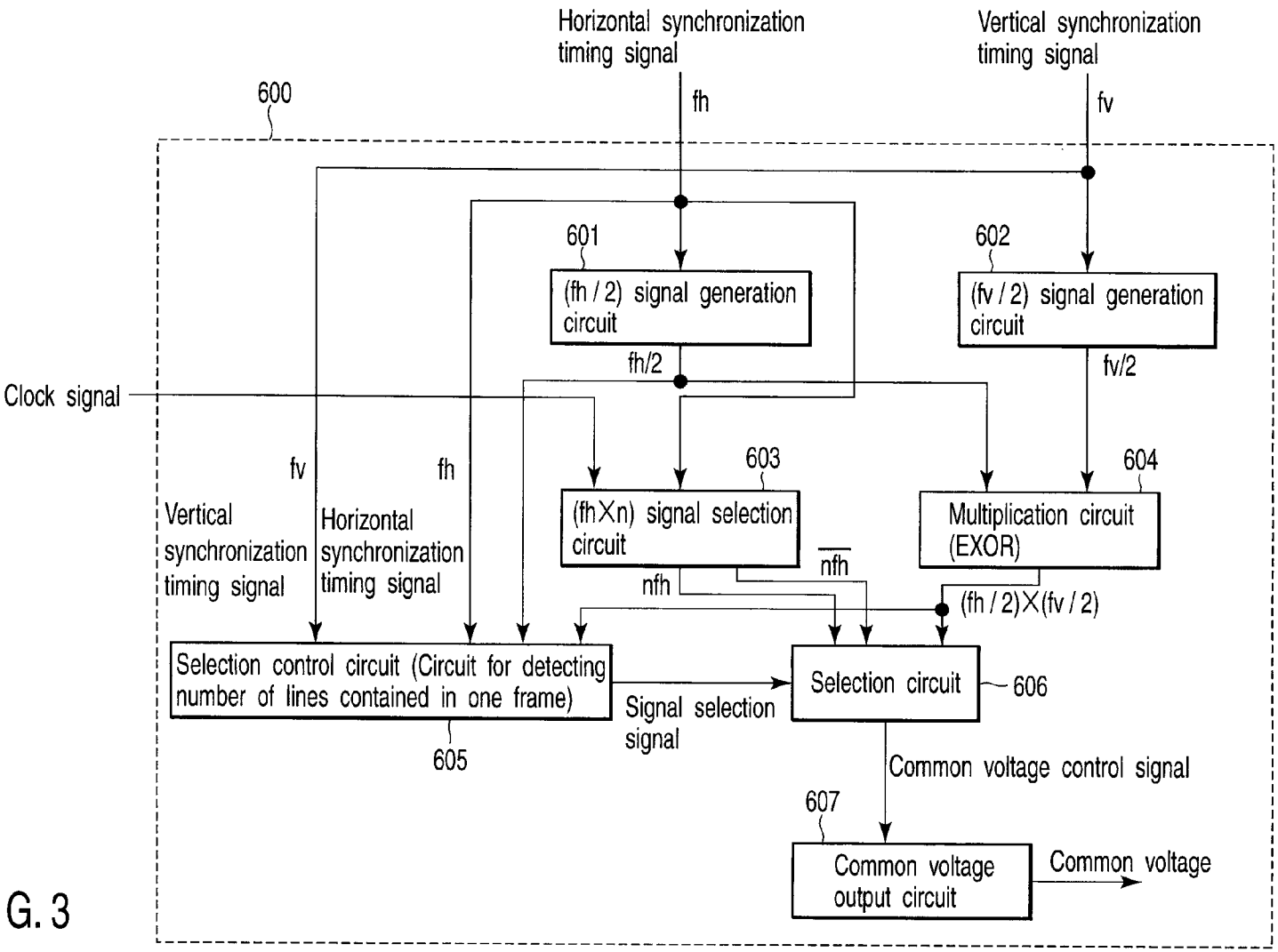
FIG. 3 is a diagram showing an example of practical configuration of the common voltage generation section 600 of FIG. 1.

FIG. 3 indicates a configuration example of a common voltage generation section 600. The common voltage generation section 600 has an (fh/2) signal generation circuit 601 for generating the first signal having frequency of (fh/2) (fh: horizontal frequency) which reverses lines on line-by-line basis, based on a horizontal synchronization timing signal fh. The common voltage generation section 600 also has an (fv/2) signal generation circuit 602 for generating the second signal having frequency of (fv/2) (fv: vertical frequency) which reverses frames on frame-by-frame basis, based on a vertical synchronization timing signal fv. The common voltage generation section 600 also has (fh×n) signal generation circuit 603 for generating the third signal of positive polarity and a third signal of negative polarity having frequency of nth of fh, based on a horizontal synchronization timing signal and a clock signal. Furthermore, the common voltage generation section 600 has a multiplication circuit (exclusive-OR circuit) 604 for generating the fourth signal by multiplying the first and second signals.

Basically, the output from the multiplication circuit 604 (the fourth signal) acts as the common voltage control signal. However, in the case where only the fourth signal acts as the common voltage control signal, AC common voltage will not become stable DC voltage when averaged. Thus, the third signal of positive polarity and the third signal of negative polarity are selected and output at appropriate timing, for supplementing the fourth signal.

The selection control circuit 605 determines which signal to adopt from among the third signal of positive polarity, the third signal of negative polarity, and the fourth signal. In response to the selected signal output from the selection control circuit 605, the selection circuit 606 selects and outputs one signal from among the third signal of positive polarity, the third signal of negative polarity, and the fourth signal. The common voltage output circuit 607 outputs common voltage based on the timing when the selected signal is output from the selection circuit 606. The selection control circuit 605 generates a selection control signal by using the horizontal synchronization timing signal fh and the vertical synchronization timing signal fv.

Figure 4:
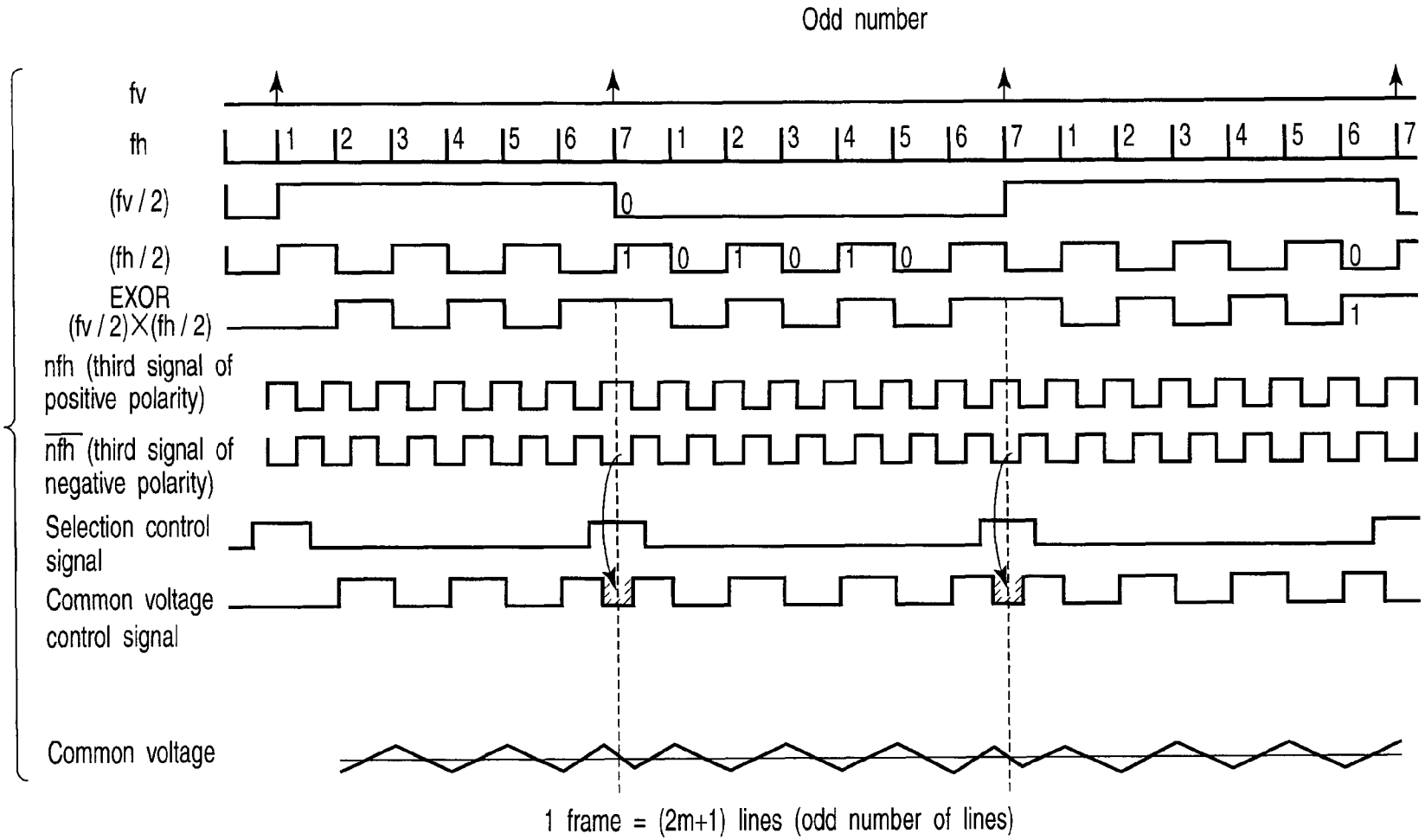
FIG. 4 is a timing chart indicated to explain an operation example of a circuit of FIG. 3.
Figure 5:
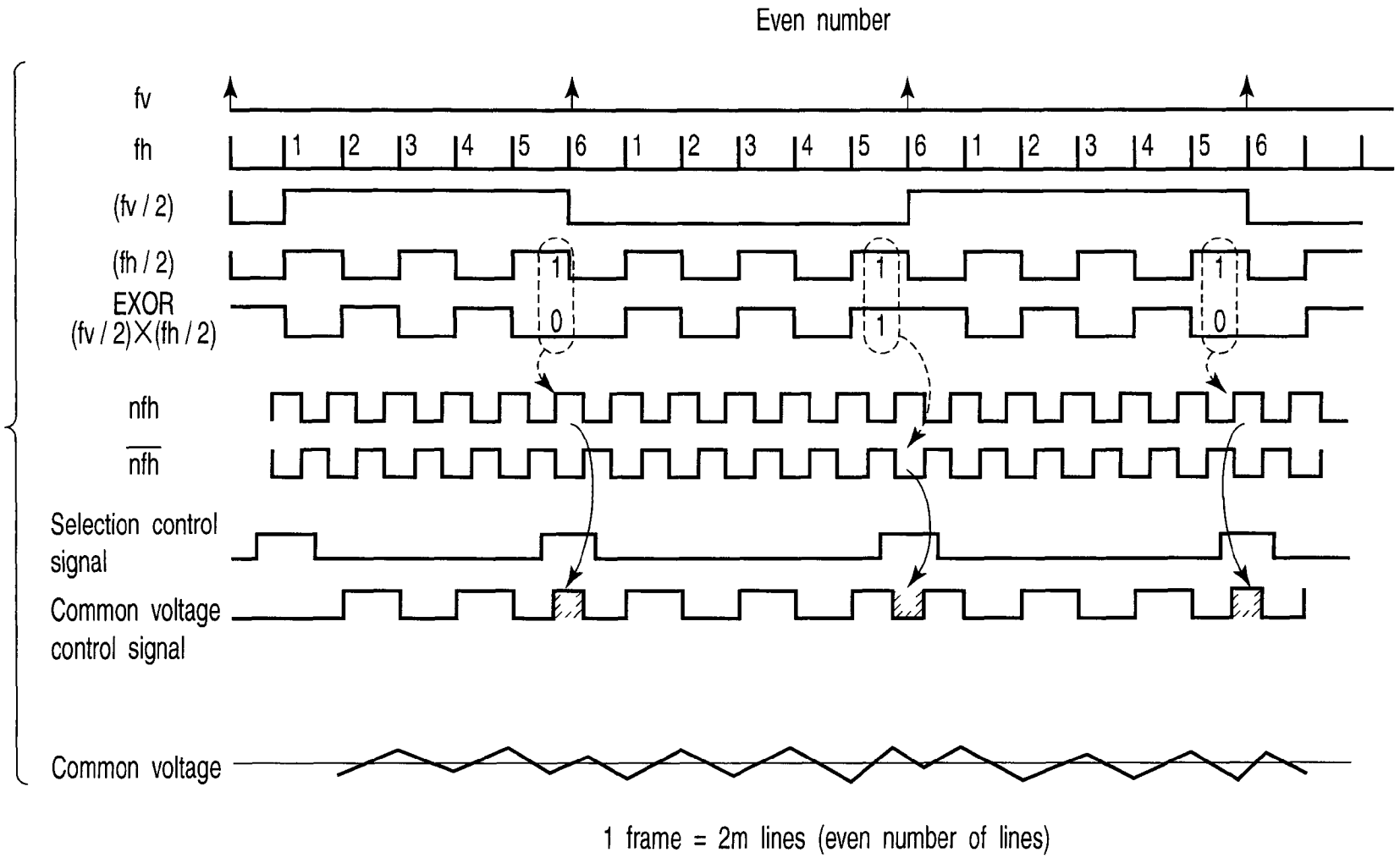
FIG. 5 is a timing chart indicated to explain another example of operation of the circuit of FIG. 3.

FIGS. 4 and 5 show examples in which a selection control signal is generated. FIG. 4 indicates an example of output signals from each circuit in the case where one frame contains the odd number of lines. FIG. 5 indicates an example of output signals from each circuit in the case where one frame contains the even number of lines.

The case where one cycle of the vertical synchronization timing signal fv contains odd cycles of horizontal synchronization timing signals fh as shown in FIG. 4 will be explained. In this example, one frame contains seven horizontal synchronization timing signals fh. There is a period of time in which the output (fh/2)×(fv/2) from the multiplication circuit 604 (the fourth signal) goes high for one horizontal period around the vertical synchronization timing signal fv. Therefore, when the fourth signal ((fh/2)×(fv/2)) is used as the common voltage control signal without any change, the average level of the common voltage varies. In order to improve this condition, a selection control signal is generated, and the common voltage control signal, in which the third signal of negative polarity is combined with the fourth signal, is generated by using the selection control signal. In the case where the common control signal is generated as described above, the DC potential of the common voltage becomes stable when averaged.

Next, even cycles of the horizontal synchronization signals fh are contained in one cycle of the vertical synchronization timing signal fv as shown in FIG. 5 will be explained. According to this example, there are six horizontal synchronization timing signals fh in one frame. In this case, there are a period of time in which the output ((fh/2)×(fv/2)) from the multiplication circuit 604 (the fourth signal) goes high for one horizontal period and a period of time in which the fourth signal goes low for one horizontal period. The former period and the latter period repeat alternately around the vertical synchronization timing signals fv. When this fourth signal ((fh/2)×(fv/2)) is used as the common voltage control signal without any change, the average level of the common voltage varies. In order to improve this condition, the common voltage control signal is generated in such a way that the third signal of positive polarity and the third signal of negative polarity are combined with a part where the fourth signal remains low for two horizontal periods and a part where the fourth signal remains high for two horizontal periods. When the common control signal is generated in this manner, the DC potential of the common voltage becomes stable when averaged.

Now, in order to obtain the above described common voltage, it is necessary to generate a selection control signal. This selection control signal should select different selection modes depending on the case where one frame contains odd cycles or on the case where the one frame contains even cycles. Therefore, the selection control circuit 605 should differentiate the case where one frame contains the odd number of horizontal synchronization signals and the case where one frame contains the even number of horizontal synchronization signals, for selecting a suitable signal.

Figure 6:
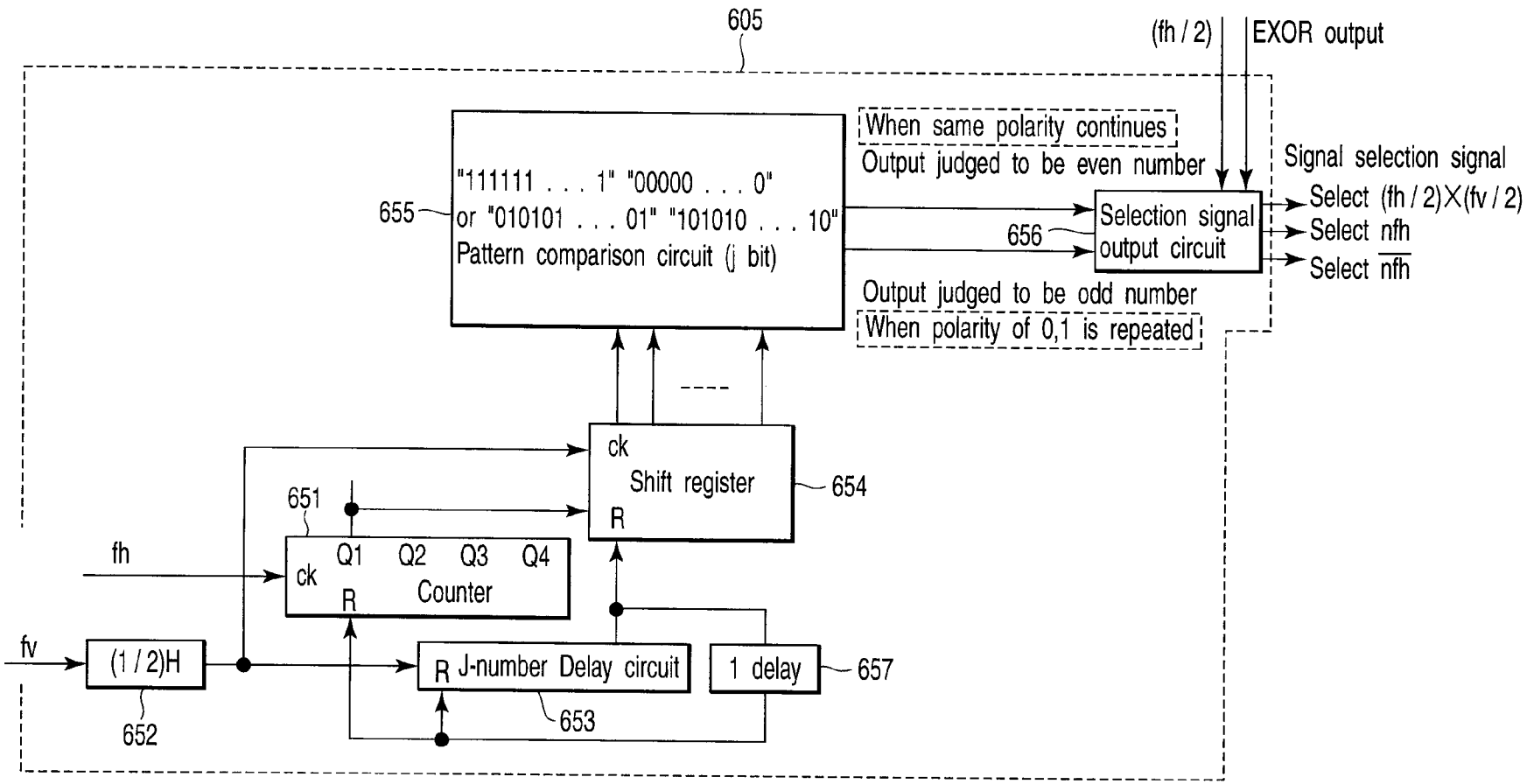
FIG. 6 is a diagram showing a configuration example of a selection control circuit of FIG. 3.

FIG. 6 shows an example of the selection control circuit 605. The horizontal synchronization timing signal fh is input to a counter 651. The vertical synchronization timing signal fv is supplied to a clock terminal of a delay circuit 653 and a clock terminal of a shift register 654, via a (½)H horizontal period delay circuit 652. The delay circuit 653 delays the vertical synchronization timing signal for J times for obtaining a reset pulse of the shift register 654, while resetting itself 653 by applying the output to the reset terminal itself through an 1 delay circuit 657. Therefore, the shift register 654 is reset every Jth vertical synchronization timing signal.

The shift register 654, after the reset, loads Q1 output from the counter 651 by using the horizontal synchronization timing signal (which is shifted by (½)H phase) as a clock. When J number of Q1 outputs from the counter 651 are loaded into the shift register 654, a comparison circuit 655 performs pattern comparison of the register data loaded into the shift register 654 with reference data.

Figure 7:
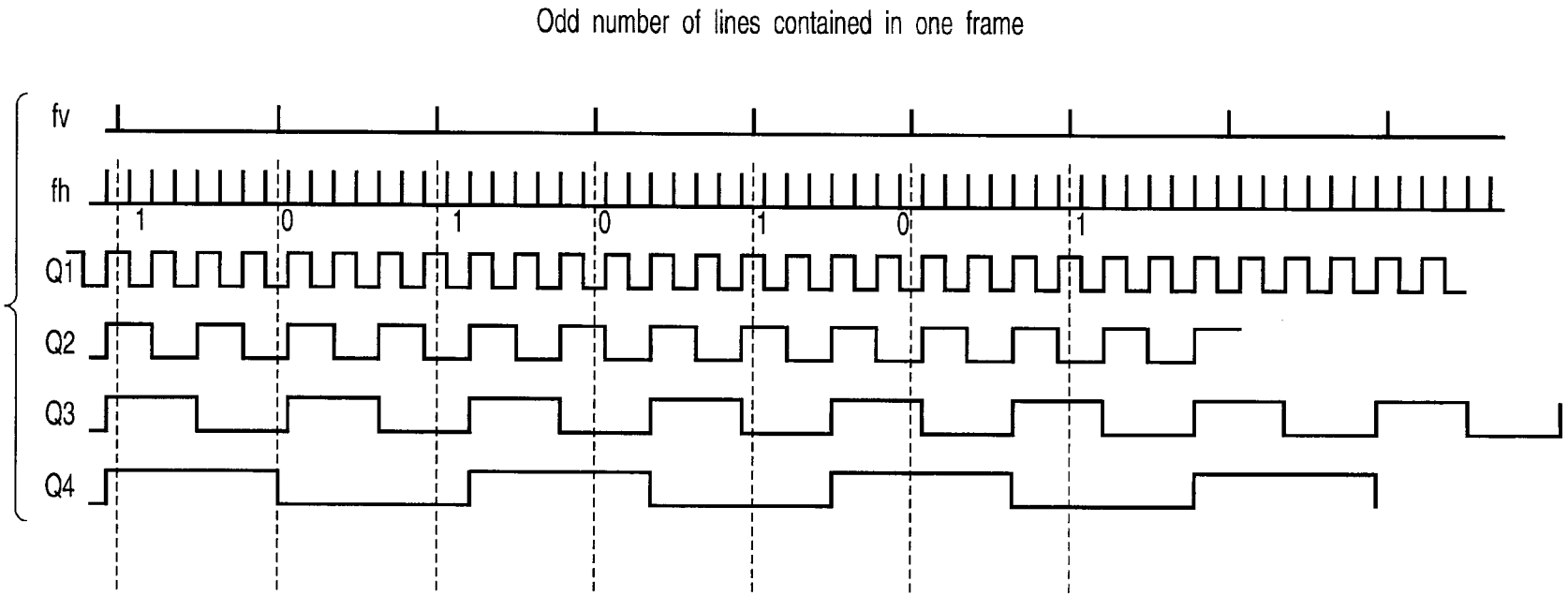
FIG. 7 is a timing chart indicated to explain an operation example of a circuit of FIG. 6.
Figure 8:
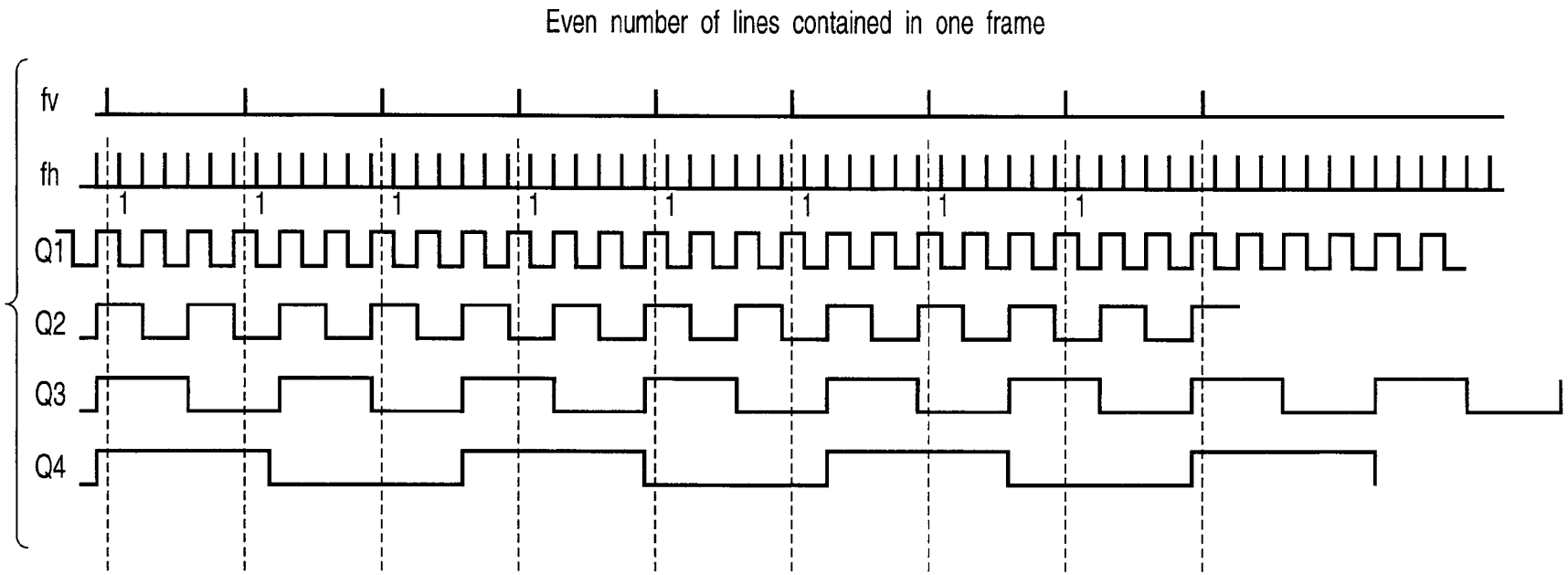
FIG. 8 is a timing chart indicated to explain another operation example of the circuit of FIG. 6.

The comparison circuit 655, as shown in FIG. 7, determines that the number of the lines contained in the present frame is odd, when register data is "01010 . . . 01" or "101 01 . . . 10". Also as shown in FIG. 8, the comparison circuit 655 determines that the number of lines contained in the present frame is even, when register data is "11111 . . . 11" or "00000 . . . 00".

This even/odd determination output is supplied to a selection signal output circuit 656. The selection signal output circuit 656 outputs a selection signal in accordance with an even/odd determination output. When an odd determination output is obtained, the selection signal output circuit 656 performs control in such a way that the third signal of negative polarity is added to the fourth signal ((fh/2)×(fv/2)) every vertical cycle as shown in FIG. 4. When an even determination output is obtained, the selection signal output circuit 656 performs control in such a way that the third signal of positive polarity and the third signal of negative polarity are add to the fourth signal ((fh/2)×(fv/2)) alternately, as shown in FIG. 5. In order to determine which of the third signal of the positive polarity and the third signal of the negative polarity is to be added, the first signal (fh/2) and a logical determination result of the fourth signal obtained from the multiplication circuit 604 is used as shown in FIG. 5. More specifically, according to the example of FIG. 5, the third signal of positive polarity is selected when the first and fourth signals are 1,0, and the third signal of negative polarity is selected when the first and fourth signals are 1,1.

Figure 9:
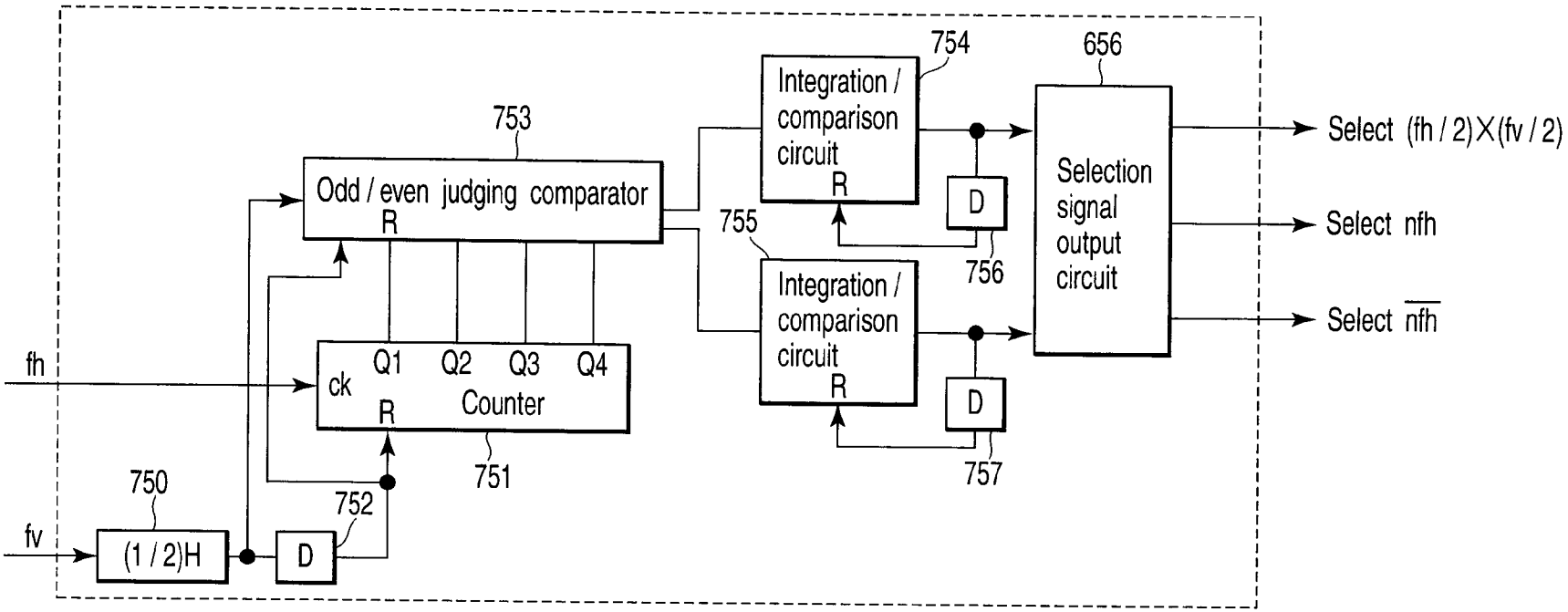
FIG. 9 is a diagram showing another configuration example of the selection control circuit of FIG. 3.

FIG. 9 shows another embodiment of the selection control circuit 605. The section control circuit may be embodied in a variety of forms. In the case of the circuit 605, the counter 751 counts the horizontal synchronization timing signal in response to the vertical synchronization timing signal. At the timing later than the horizontal synchronization timing signal, outputs from the counter 751 are compared by an even/odd determination comparator 753 in response to the vertical synchronization timing signal. With these operations, a determination output indicating whether a counter output is odd or even can be obtained, and the output determined to be even is input to an integration/comparison circuit 754 and the output determined to be odd is input to an integration/comparison circuit 755. Furthermore, after this operation, the counter 751 is reset while simultaneously data input to the odd/even determination comparator 753 is reset.

The integration/comparison circuit 754 and the integration/comparison circuit 755 determine whether or not several frames or several dozen of frames of the same determination outputs can be obtained. For instance, when ten frames of the same even determinations are obtained, a proper output determined to be even is input to a selection signal output circuit 656. Moreover, when ten frames of the same odd determinations are obtained, for instance, a proper output determined to be odd is input to the selection signal output circuit 656. The operation of the selection signal output circuit is as described above.

According to the above-mentioned device, the common voltage generation section is pre-configured in a semiconductor circuit. This configuration enables the device to automatically comply with all types of input video signals. According to the present invention, even when the common electrode is driven on AC, it is possible to suppress the variation of brightness of the screen which occurs depending on the number of lines of a video signal to be input.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Furthermore, various inventions can be formed due to the plurality of structural elements which have been disclosed in the above-described embodiments being appropriately combined. For example, several structural elements may be eliminated from all of the structural elements shown in the embodiments. Furthermore, structural elements over different embodiments may be appropriately combined.

What is claimed is:

1. A flat display device which makes drive voltage polarity of pixels of adjacent lines reversed polarity, while drives to reverse drive voltage polarity of a same line on a frame-by-frame basis, wherein the flat display device comprises common voltage generation means for supplying a common voltage signal to a facing electrode of the flat display device and means for generating a common voltage control signal supplied to the common voltage generation means, characterized in that the means for generating a common voltage control signal comprises:

means for generating, based on a horizontal synchronization timing signal fh, a first signal having frequency of fh/2 which reverses lines on a line-by-line basis;

means for generating, based on a vertical synchronization timing signal fv, a second signal having frequency of fv/2 which reverses frames on a frame-by-frame basis;

means for generating, based on the horizontal synchronization timing signal and a clock signal, a third signal of positive polarity and a third signal of negative polarity having frequency of nth of fh;

multiplication means for performing multiplication of the first and second signals and outputting a fourth signal;

selection means to which the third signal having positive polarity, the third signal having negative polarity, and the fourth signal are supplied, for selecting and outputting one of said third signal having positive polarity, third signal having negative polarity and said fourth signal;

selection control means for determining signal selection mode according to whether one cycle of the second signal contains odd cycles of the first signals or even cycles of the first signals; and common voltage output means for generating, based on the outputted signal obtained from the selection means, the common voltage signal.

2. The flat display device according to claim 1, characterized in that the selection control means comprises a counter being reset by the vertical synchronization timing signal and counting the horizontal synchronization timing signal.

3. The flat display device according to claim 1, characterized in that the selection control means comprising:

a counter being reset by the vertical synchronization timing signal and counting the horizontal synchronization signal;

an odd/even determination comparator for determining whether a count output from the counter is odd or even in number;

first multiplication means for integrating an output determined to be odd in number, which is output from the odd/even determination comparator, by a number equal to a plurality of cycles, and obtaining a proper output determined to be odd in number when an integration value exceeds a predetermined value; and second multiplication means for integrating an output determined to be even in number, which is output from the odd/even determination comparator, by a number equal to a plurality of cycles, and obtaining a proper output determined to be even in number when an integration value exceeds a predetermined value.

4. A flat display device which makes drive voltage polarity of pixels of adjacent lines reversed polarity, while drives to reverse drive voltage polarity of a same line on a frame-by-frame basis, wherein the flat display device comprises common voltage generation means for supplying a common voltage signal to a facing electrode of the flat display device and means for generating a common voltage control signal supplied to the common voltage generation means, characterized in that the common voltage signal generation means which generates a common voltage signal which is AC:

generates, by using an fh/2 signal generation circuit, a first signal having frequency of fh/2, wherein fh is a horizontal synchronization timing signal which reverses lines on a line-by-line basis based on a horizontal synchronization timing signal;

generates, by using an fv/2 signal generation circuit, a second signal having frequency of fv/2, wherein fv is a verticall synchronization timing signal which reverses frames on a frame-by-frame basis based on a vertical synchronization timing signal;

generates, by using an (fh×n) signal generation circuit, a third signal of positive polarity and a third signal of negative polarity having frequency of nth of fh based on the horizontal synchronization timing signal and a clock signal;

generates, by using a multiplication circuit, a fourth signal by performing multiplication of the first and the second signals;

selects and outputs, from a selection circuit, one of the third signal of positive polarity, the third signal of negative polarity, and the fourth signal that are supplied to the selection circuit;

determines, by using a selection control circuit, signal selection mode of the selection circuit according to whether one cycle of the second signal contains odd cycles of the first signals or even cycles of the first signals; and generates the common voltage signal based on the outputted signal obtained from the selection circuit.

* * * * *